US006639366B2

(12) United States Patent
Bai

(10) Patent No.: US 6,639,366 B2
(45) Date of Patent: Oct. 28, 2003

(54) POWER SUPPLY CIRCUIT FOR A COLD-CATHODE FLUORESCENT LAMP

(75) Inventor: Shwang-Shi Bai, Taipei (TW)

(73) Assignee: Chi Mei Optoelectronics Corp. (TW)

( * ) Notice: Subject to any disclaimer, the term of this patent is extended or adjusted under 35 U.S.C. 154(b) by 0 days.

(21) Appl. No.: 10/247,728

(22) Filed: Sep. 20, 2002

(65) Prior Publication Data

US 2003/0076054 A1 Apr. 24, 2003

(30) Foreign Application Priority Data

Oct. 22, 2001 (TW) ..... 90126086 A

(51) Int. Cl.[7] ..... H05B 41/36

(52) U.S. Cl. ..... 315/219; 315/224; 315/225; 315/DIG. 2; 315/DIG. 5; 323/355

(58) Field of Search ..... 315/219, 223, 315/224, 225, 209 CD, 242, 244, 289, 291, 307, DIG. 2, DIG. 5, DIG. 7; 323/355; 363/41, 123, 126, 127

(56) References Cited

U.S. PATENT DOCUMENTS

| | | | | |
|---|---|---|---|---|
| 5,072,155 A | * | 12/1991 | Sakurai et al. | 315/219 |
| 5,548,189 A | * | 8/1996 | Williams | 315/224 |
| 5,619,402 A | * | 4/1997 | Liu | 363/20 |
| 6,130,509 A | * | 10/2000 | Kates et al. | 315/224 |
| 6,198,236 B1 | * | 3/2001 | O'Neill | 315/307 |
| 6,380,695 B1 | * | 4/2002 | Lin et al. | 315/291 |

* cited by examiner

*Primary Examiner*—Don Wong
*Assistant Examiner*—Thuy Vinh Tran
(74) *Attorney, Agent, or Firm*—Rabin & Berdo, PC

(57) ABSTRACT

A power supply circuit for a cold-cathode fluorescent lamp (CCFL). The power supply circuit converts a DC voltage to a high AC voltage for driving the CCFL. The power supply circuit includes: a switch; a switch control circuit for controlling the switch; a transformer for stepping up the voltage; an energy-preserving unit coupled to the transformer and the DC voltage output circuit; a first diode coupled to the transformer, the energy-preserving unit, and the switch; and a decoupling capacitor coupled to the transformer for outputting the high AC voltage.

11 Claims, 11 Drawing Sheets

POWER SUPPLY CIRCUIT FOR A COLD-CATHODE FLUORESCENT LAMP

This application incorporates by reference Taiwan application Serial No. 90126086, filed Oct. 22, 2001.

BACKGROUND OF THE INVENTION

1. Field of the Invention

The invention relates in general to the power supply circuit converting a DC voltage to a AC voltage, and more particularly to the power supply circuit for a cold-cathode fluorescent lamp.

2. Description of the Related Art

The LCD (Liquid Crystal Display) monitor is popular in these years because of being low in radiation, lightweight and compact. For example, portable electronic devices such as the notebook computers are equipped with LCDs for portable purposes.

The LCD panels can be classified into a reflective type and a transmissive type. The LCD panels of the transmissive type require back lighting. Cold-Cathode Fluorescent Lamp (CCFL) is commonly used as back lighting source, because it needs only simple control circuits and has the high power efficiency and longer life. The CCFL is started up by supplying a high AC voltage thereto. In a notebook computer, the high AC voltage is supplied by a power supply circuit, which converts the DC voltage outputted by the battery into the high AC voltage.

FIG. 1 is a diagram of a conventional power supply circuit 100 for the CCFL. The power supply circuit 100 is the Royer type circuit, which includes switches 104, 106, and a transformer 108. The power supply circuit 100 converts the DC voltage outputted by the DC voltage output circuit 102 into a high AC voltage for driving the CCFL 110. The transformer 108 is used for stepping up the voltage inputted thereto. The switches 104 and 106 are bipolar junction transistors (BJT). The collectors of the switches 104 and 106 are coupled to the two end nodes of the primary side of the transformer 108, respectively. The middle node of the primary side of the transformer 108 is coupled to the positive node of the DC voltage output circuit 102. The emitters of the switches 104 and 106 are coupled to the negative node of the DC voltage output circuit 102. The two nodes of the feedback circuit 112 of the secondary side of the transformer 108 are coupled to the bases of the switches 104 and 106, respectively. The bias resistance R1 is coupled between the positive node of the DC voltage output circuit 102 and the base of the switch 104. The CCFL 110 and the decoupling capacitor C1 are connected serially with the secondary side of the transformer 108.

FIG. 2A is the equivalent circuit diagram of the power supply circuit 100 while the switch 104 is on and the switch 106 is off. FIG. 2B is the equivalent circuit diagram of the power supply circuit 100 while the switch 104 is off and the switch 106 is on. The voltage outputted by the DC voltage output circuit 102 controls the on/off status of the switches 104 and 106, and the polarity of the primary side of the transformer 108 changes accordingly, as shown in FIGS. 2A and 2B. The polarity of voltage of the secondary side of the transformer 108 also changes according to that of the primary side. The transformer 108 steps up the AC voltage at the primary side and outputs the high AC voltage to the CCFL 110 via the decoupling capacitor C1 at the secondary side, according to the turn ratio of the primary side and the secondary side.

The main disadvantage of the power supply circuit 100 is the low power efficiency, which is about 70%~80%. Thus the usage time of the battery after each charge is reduced. The lifetime of the CCFL is also reduced. The transformer 108 has a complex structure that makes it expensive and difficult to manufacture.

FIG. 3 is a diagram of another power supply circuit 300 for the CCFL. The power supply circuit 300 includes switches 304 and 306, formed with MOSFETs, the capacitor C1 and a transformer 308. The switch 304 is an N-channel MOSFET, and the drain thereof is coupled to one node of the primary side of the transformer 308, and the other node of the primary side is coupled to the positive node of the DC voltage output circuit 302. The on/off statuses of the switch 304 and 306 are controlled by the switch control circuit 312. The negative node of the capacitor C1 is connected to the drain of the switch 306, and the positive node thereof is connected to both the drain of the switch 304 and one node of the primary side of the transformer 308. Two nodes of the diode D1 are connected to the drain and the source of the switch 304, respectively. And two nodes of the diode D2 are connected to the drain and the source of the switch 306, respectively. The diodes D1 and D2 are either the intrinsic diodes of the MOSFETs, or external diodes connected to the MOSFETs.

The operation of the power supply circuit 300 is described in FIGS. 4A to 4C. FIG. 4A is the equivalent circuit diagram of the power supply circuit 300 when the switch 304 is on and the switch 306 is off. The DC voltage output circuit 302 supplies a positive voltage to the primary side of the transformer 308, and the corresponding current flows from the DC voltage output circuit 302, to the transformer 308, and then to the switch 304. FIG. 4B is the equivalent circuit diagram of the power supply circuit 300 when the switches 304 and 306 are off. At this time, the voltage of the primary side of the transformer 308 is still positive, but the magnitude of the voltage thereof decreases with time. The current flows from the primary side of the transformer 308 to the capacitor C1 for energy preserving and charges the capacitor C1 to make the voltage thereof increases with time. FIG. 4C is the equivalent circuit diagram of the power supply circuit 300 when the switch 304 is off and the switch 306 is on. At this time, the capacitor C1 discharges and the voltage of the primary side of the transformer 308 is negative. By alternating the on and off status of the switches 304 and 306, the polarity of the voltage of the transformer 308 also alternates, as shown in FIGS. 4A to 4C. At the same time, the primary current I1 that flows through the primary side of the transformer 308, and the secondary current I2 that flows through the secondary side of the transformer 308 each also alternates the flow direction accordingly.

The disadvantage of the power supply circuit 300 is that the control mechanism is complex because three phases are required for the switch control circuit 312 to control the on/off status of the switches 304 and 306. Besides, the precise timing control of the on/off status of the switches 304 and 306 are required and thus the control mechanism is more complex.

FIG. 5 is another well-known diagram of the power supply circuit 500. The power supply circuit 500 includes the energy-preserving capacitor C1 coupled to the primary side of the transformer 512 in parallel, the energy-preserving inductor L1 coupled to the energy-preserving capacitor C1 and the primary side of the transformer 512, and four MOSFETs used as switches 504, 506, 508, and 510. The switch 504 is electrically connected to the positive node of the DC voltage output circuit 502, energy-preserving inductor L1 and the switch 506. The switch 508 is electrically connected to the positive node of the DC voltage output circuit 502, the primary side of the transformer 512, the capacitor C1 and the switch 510. The switch 506 is further connected to the switch 510.

The operation scheme is described in FIGS. 6A~6D. FIG. 6A is the equivalent circuit diagram of the power supply circuit 500 while the switch 504 and 510 are on, and the switch 506 and 508 are off. At this time, the DC voltage output circuit 502 charges the energy-preserving capacitor C1 and the energy-preserving inductor L1. The polarity of the primary side of the transformer 512 is positive, and the magnitude of the voltage thereof increases with time. The current flows from the energy-preserving inductor L1 to the primary side of the transformer 512. FIG. 6B is the equivalent circuit diagram of the power supply circuit 500 while the switch 506 and 510 are on, and the switch 504 and 508 are off. At this time, the capacitor C1 discharges, and the current flows form the capacitor C1 to the primary side of the transformer 512, the polarity of the voltage of the primary side is still positive, and the voltage of the primary side decreases with time. FIG. 6C is the equivalent circuit diagram of the power supply circuit 500 while the switch 506 and 508 are on, and the switch 504 and 510 are off. At this time, the DC voltage output circuit 502 charges the energy-preserving inductor L1 and the energy-preserving capacitor C1. The polarity of the primary side of the transformer 512 is negative, and the voltage thereof decreases with time. The direction of the current, flowing through the primary side, is different from that in the equivalent circuit shown in FIG. 6B. FIG. 6D is the equivalent circuit diagram of the power supply circuit 500 while the switch 506 and 510 are on, and the switch 504 and 508 are off. At this time, the capacitor C1 discharges, and the current flows from the capacitor C1 to the primary side of the transformer 512. The polarity of the voltage of the primary side is still negative, but the magnitude of the voltage of the primary side increases with time. Thus, the polarity of the voltage of the primary side of the transformer 512 alternates between positive and negative according to the alternative change of the on/off status of the switches 504, 406, 508, and 510. And the current I1 that flows through the primary side of the transformer 512 and the current I2 that flows through the secondary side of the transformer 512 also alternate directions accordingly as shown in FIGS. 6A~6D.

The disadvantage of the power supply circuit 500 is that the manufacture is complex because four switches are required, and the control mechanism is complex because the control mechanism needs to precisely control the on/off status of the switches 504, 506, 508, and 510 in four different phases.

SUMMARY OF THE INVENTION

It is therefore an object of the invention to provide an improved and simplified power supply circuit for the CCFL, which has the following advantages:

1. Manufacturing of the power supply circuit is easy.
2. Control mechanism is easy.
3. Power efficiency is good.

The invention achieves the above-identified objects by providing a power supply circuit. The power supply circuit for the CCFL is coupled to a DC (Direct Current) voltage output circuit and the CCFL. The DC voltage output circuit outputs a low DC voltage, and then the power supply circuit converts the low DC voltage to a high AC voltage for driving the CCFL. The power supply circuit includes a switch, a switch control circuit, a transformer, an energy-preserving unit, and a decoupling capacitor. The switch has a control node, a ground node, and a signal node. The switch control circuit is coupled to the control node, for outputting a control signal to control the on/off status of the switch. The transformer has a primary side and a secondary side. The primary side has the first node and the second node, and the secondary side has the third node and the fourth node. The first node is coupled to the DC voltage output circuit, the second node is coupled to the signal node of the switch. The energy-preserving unit is for preserving electrical energy. The energy-preserving unit has a fifth node and a sixth node. The fifth node is coupled to the first node of the primary side of the transformer and the DC voltage output circuit. The decoupling capacitor is coupled to the third node of the secondary side of the transformer for outputting the high AC voltage.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIG. 2B is the equivalent circuit diagram of the power supply circuit 100 when the switch 104 is off and the switch 106 is on.

FIG. 4C is the equivalent circuit diagram of the power supply circuit 300 while the switch 304 is off and the switch 306 is on.

FIG. 9A is the equivalent circuit diagram of the power supply circuit diagram 700 while the switch 704 is on.

DETAILED DESCRIPTION OF THE INVENTION

Figure 1:
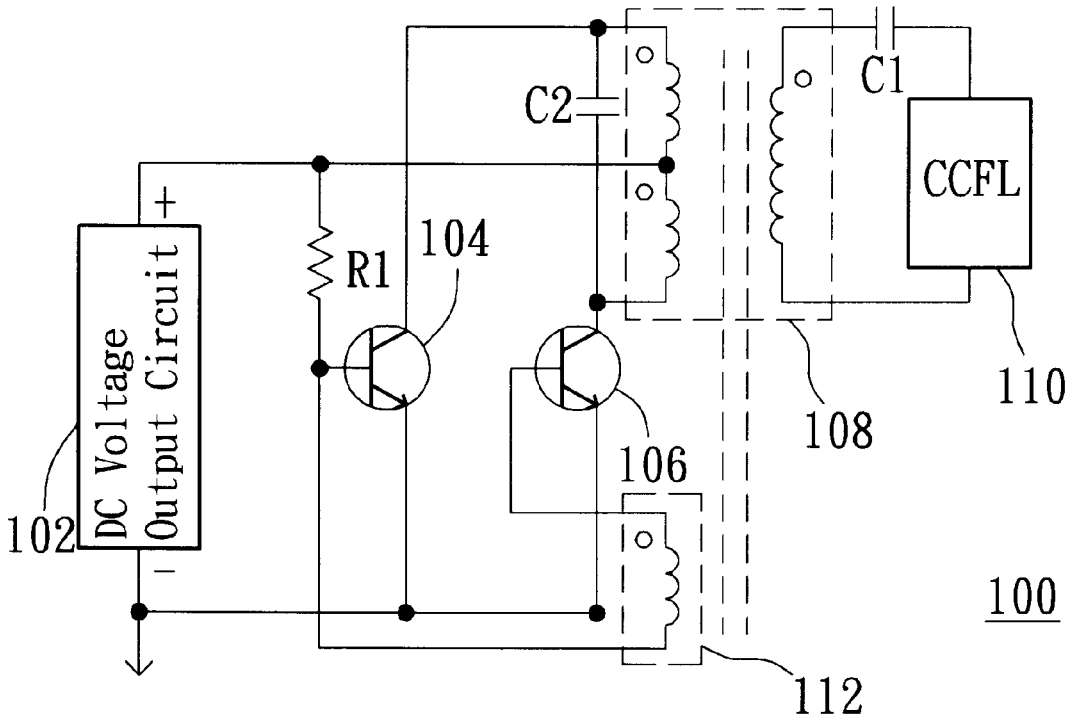
FIG. 1 (PRIOR ART)
FIG. 1 is a circuit diagram of a conventional power supply circuit 100.
Figure 2A:
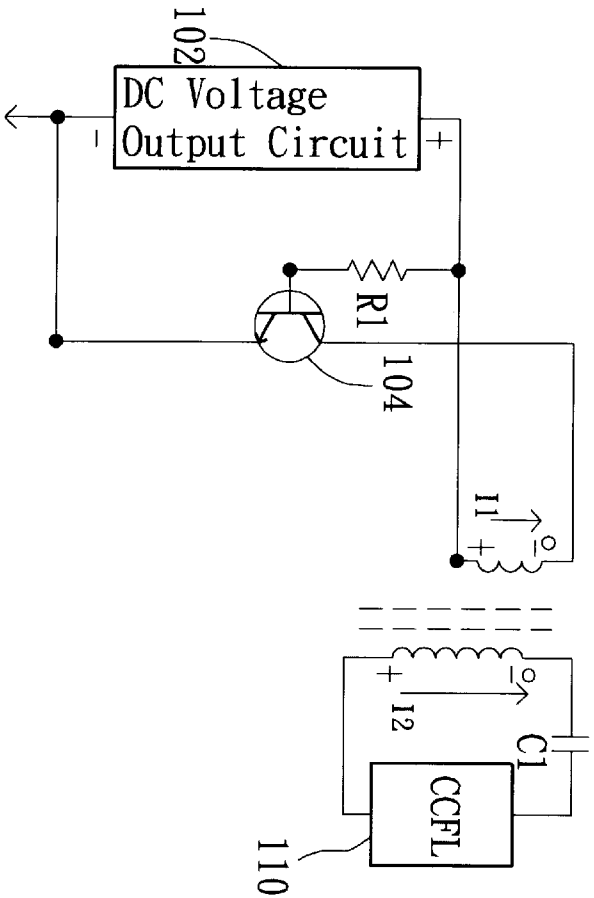
FIG. 2A (PRIOR ART)
FIG. 2A is the equivalent circuit diagram of the power supply circuit 100 when the switch 104 is on and the switch 106 is off.
Figure 2B:
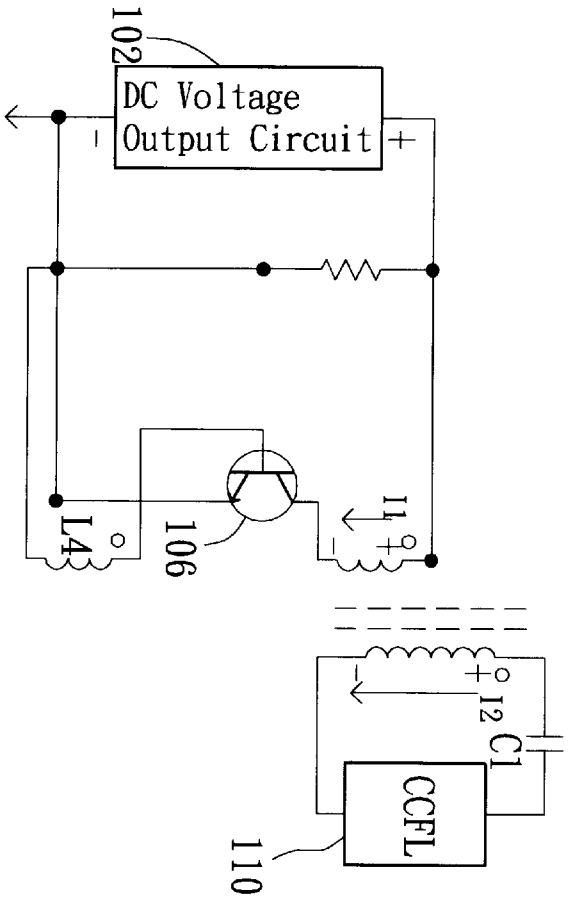
FIG. 2B (PRIOR ART)
Figure 3:
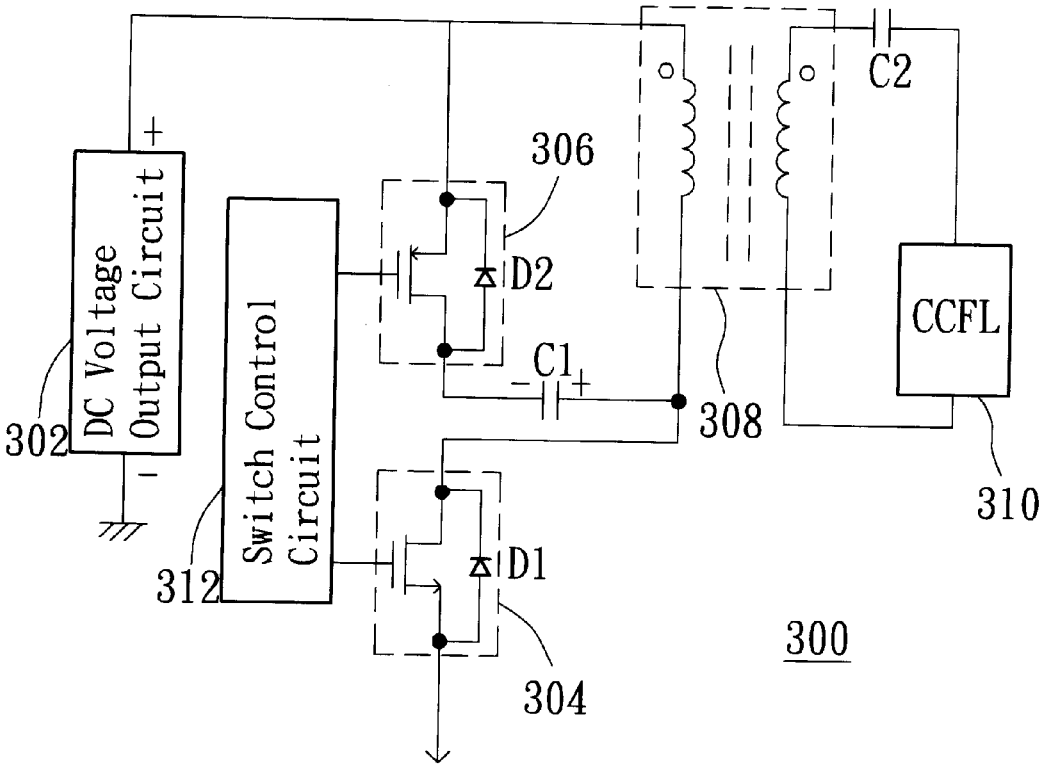
FIG. 3 (PRIOR ART)
FIG. 3 is a circuit diagram of a power suply circuit 300.
Figure 4A:
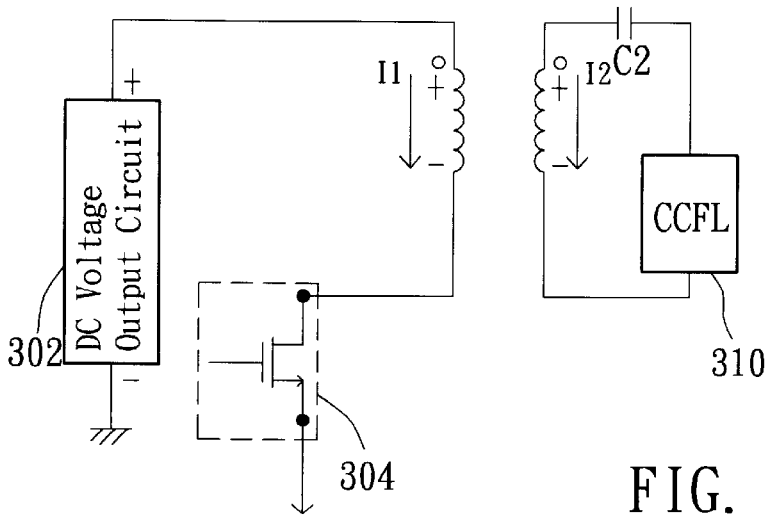
FIG. 4A (PRIOR ART)
FIG. 4A is the equivalent circuit diagram of the power supply circuit 300 while the switch 304 is on and the switch 306 is off.
Figure 4B:
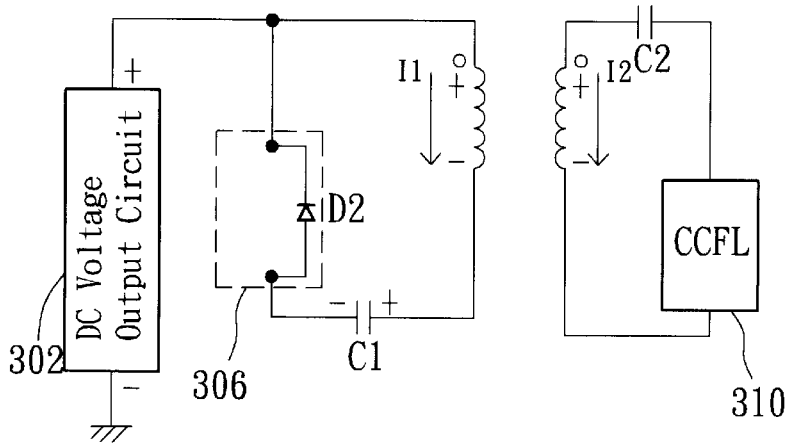
FIG. 4B (PRIOR ART)
FIG. 4B is the equivalent circuit diagram of the power supply circuit 300 while the switches 304 and 306 are off.
Figure 4C:
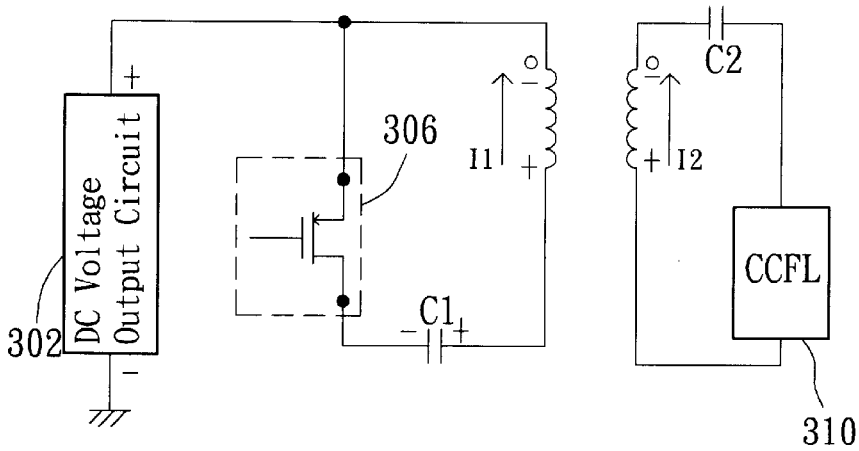
FIG. 4C (PRIOR ART)
Figure 5:
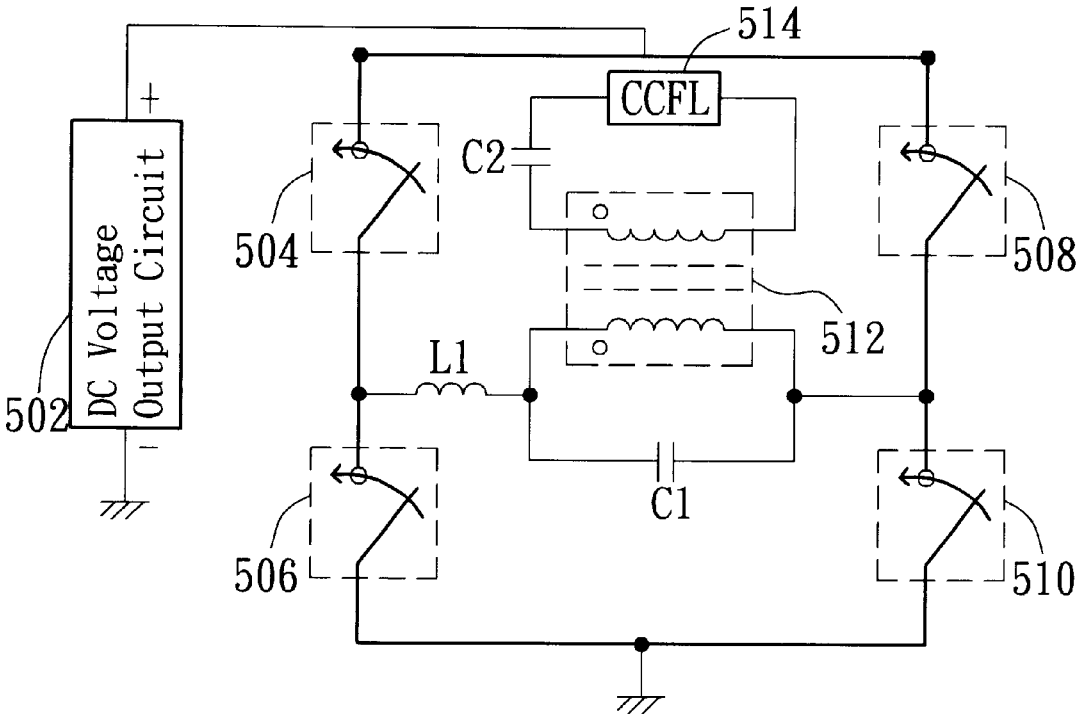
FIG. 5 (PRIOR ART)
FIG. 5 is another well-known circuit diagram of the power supply circuit 500.
Figure 6A:
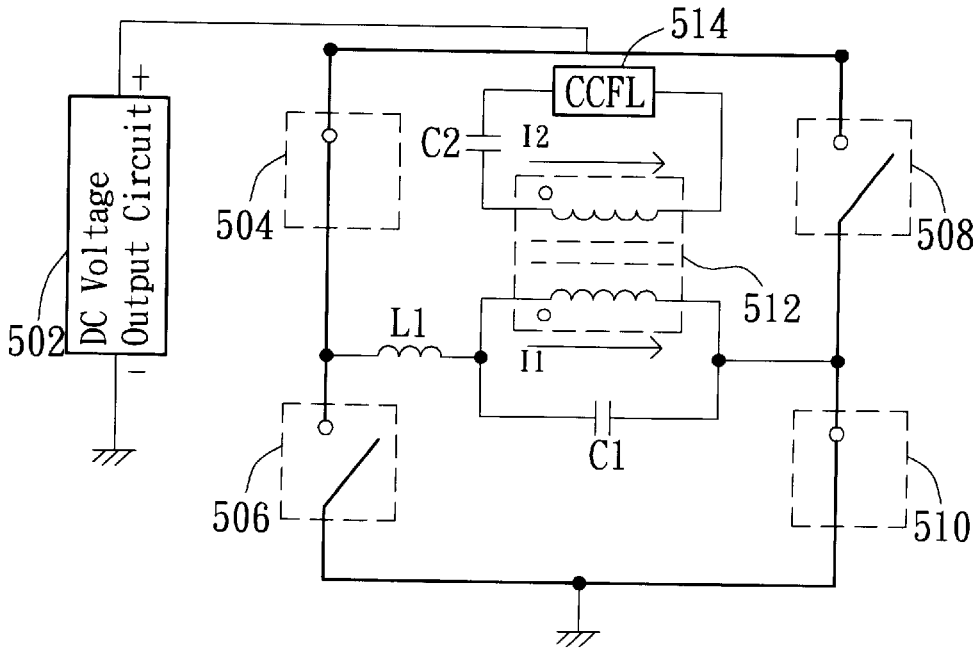
FIG. 6A (PRIOR ART)
FIG. 6A is the equivalent circuit diagram of the power supply circuit 500 while the switch 504 and 510 are on, and the switch 506 and 508 are off.
Figure 6B:
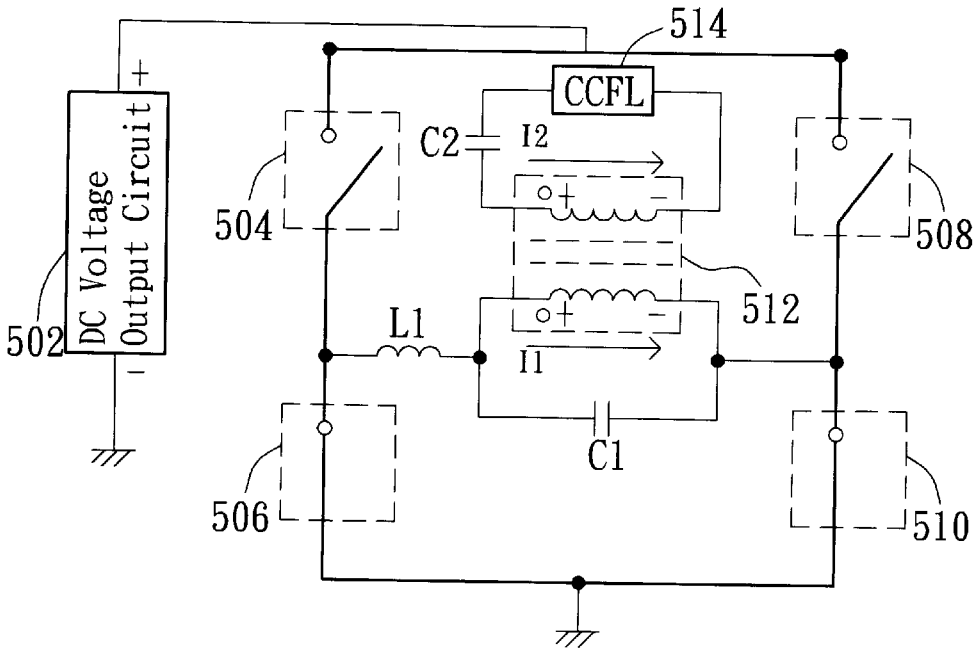
FIG. 6B (PRIOR ART)
FIG. 6B is the equivalent circuit diagram of the power supply circuit 500 while the switch 506 and 510 are on, and the switch 504 and 508 are off.
Figure 6C:
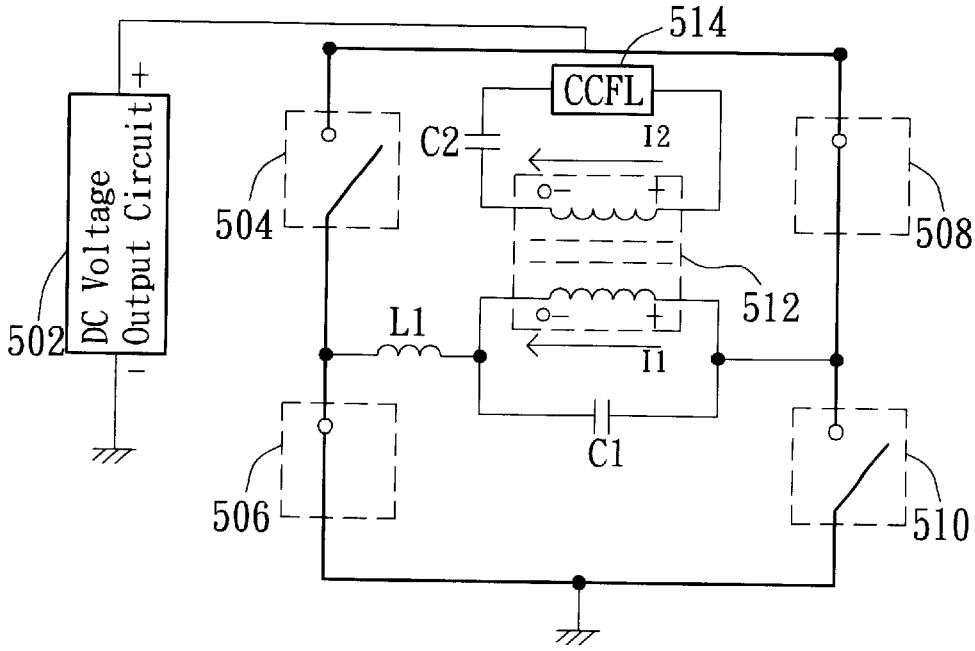
FIG. 6C (PRIOR ART)
FIG. 6C is the equivalent circuit diagram of the power supply circuit 500 while the switch 506 and 508 are on, and the switch 504 and 510 are off.
Figure 6D:
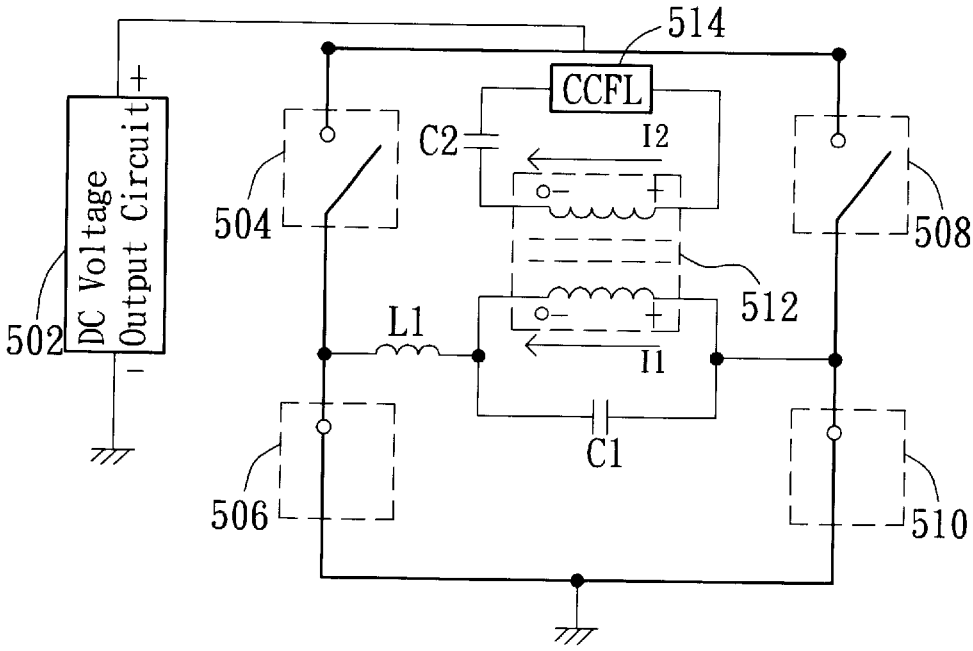
FIG. 6D (PRIOR ART)
FIG. 6D is the equivalent circuit diagram of the power supply circuit 500 while the switch 506 and 510 are on, and the switch 504 and 508 are off.
Figure 7A:
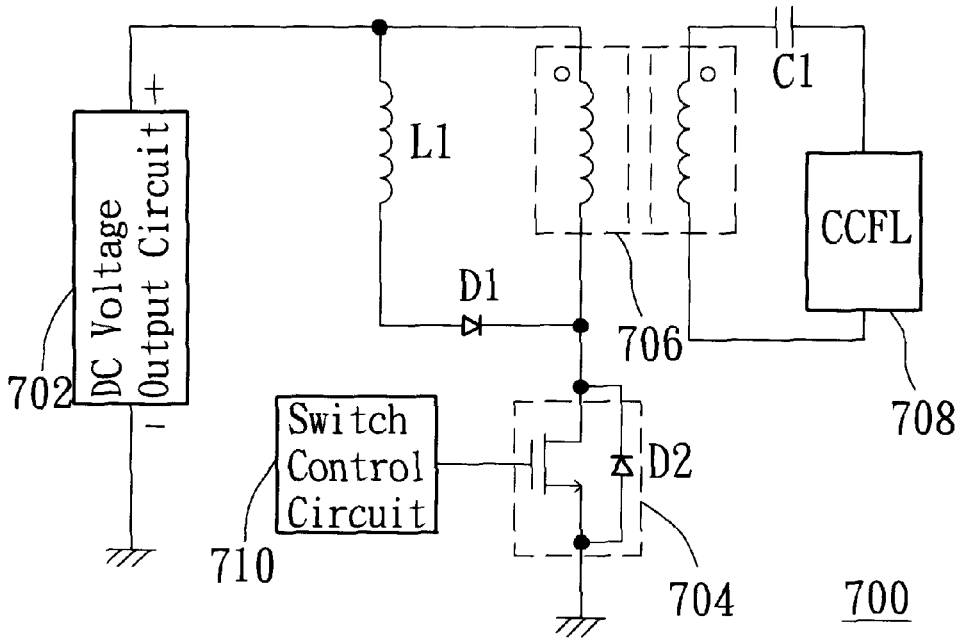
FIG. 7A is a power supply circuit 700 for the cold-cathode fluorescent lamp (CCFL) according to this invention.

FIG. 7A is a power supply circuit 700 for the cold-cathode fluorescent lamp (CCFL) according to this invention. The power supply circuit 700 converts the DC voltage, outputted by the DC voltage output circuit 702, to the high AC voltage for driving the CCFL. The power supply circuit 700 utilizes a switch 704, such as an N-channel MOSFET, an energy-preserving inductor L1, a first diode D1, and a second diode D2 to accomplish the object of the invention. The gate of the switch 704 is electrically connected to the switch control circuit 710, the drain thereof is electrically connected to one node of the primary side of the transformer 706, and the source thereof is grounded. The other node of the primary side of the transformer 706 is electrically connected to the DC voltage output circuit 702 and an energy-preserving inductor L1. The first diode D1 is coupled between the inductor L1 and the switch 704.) The positive node of the second diode D2 is connected to the source of the switch 704, and the negative node thereof is connected to the drain of the switch 704. The second diode D2 is either the intrinsic body diode of the MOSFET, or the external diode connected in parallel with the MOSFET. The secondary side of the transformer 706 is connected to the decoupling capacitor C1 and the CCFL 708 in series.

Figure 8:
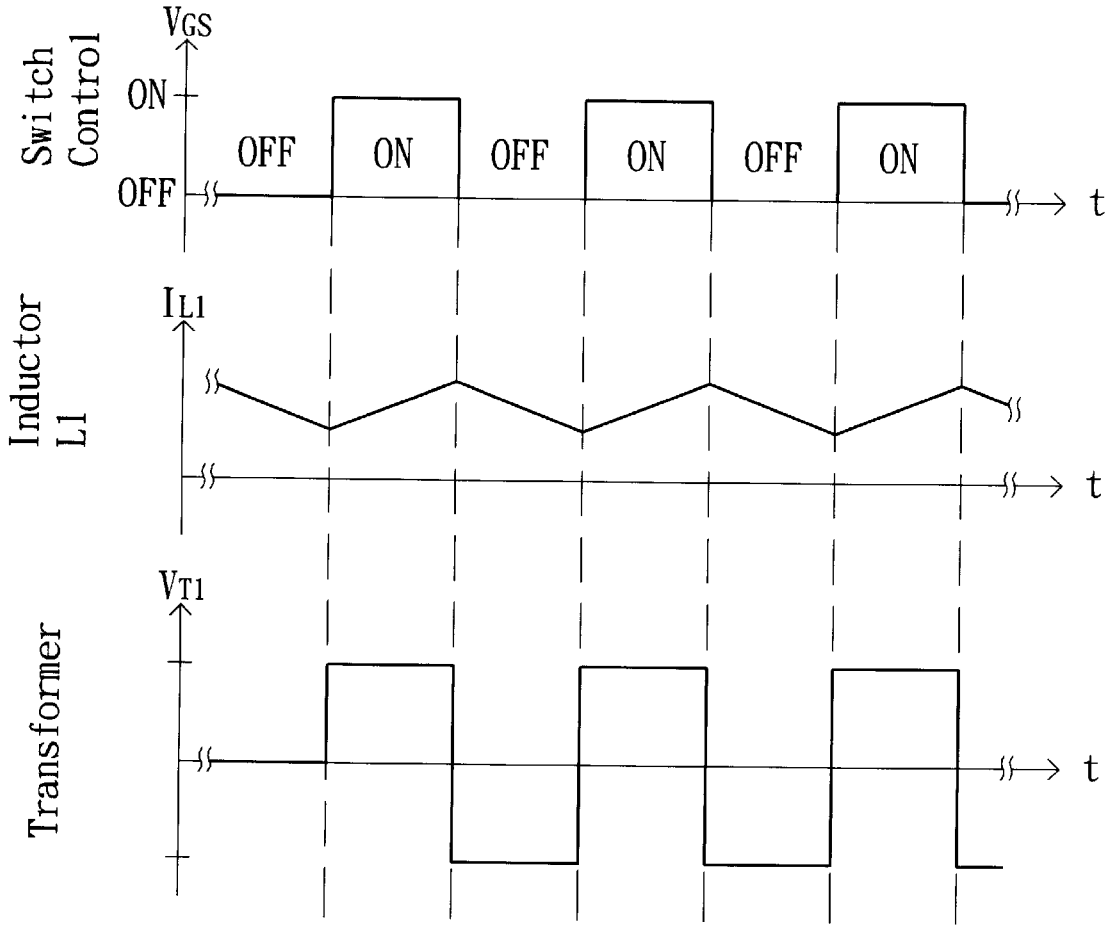
FIG. 8 is a timing diagram of the gate-source voltage $V_{GS}$ of the switch 704, the inductor current $I_{L1}$ of the inductor L1, and the primary voltage $V_{T1}$ of the primary side of the transformer 712.
Figure 9A:
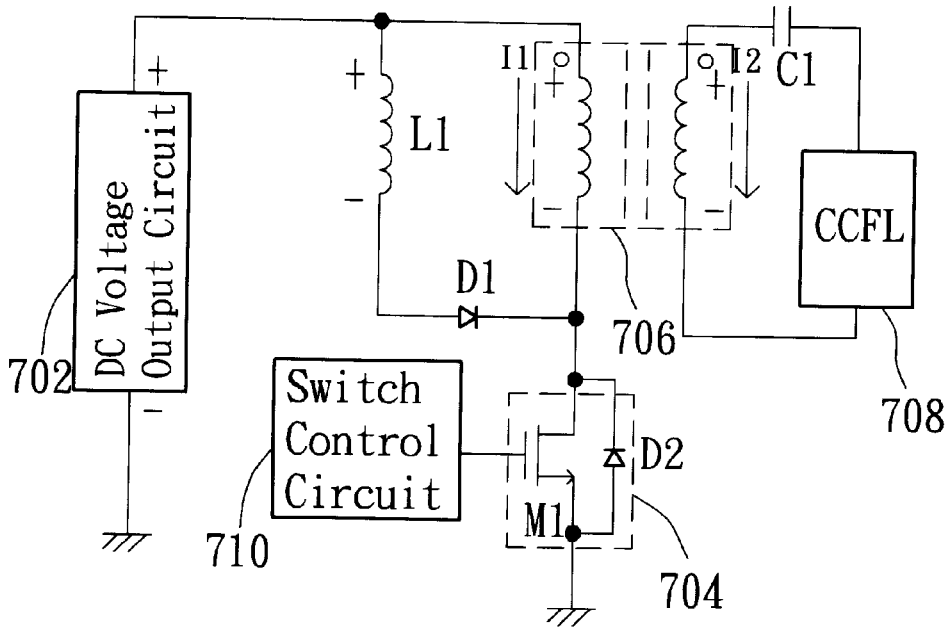
Figure 9B:
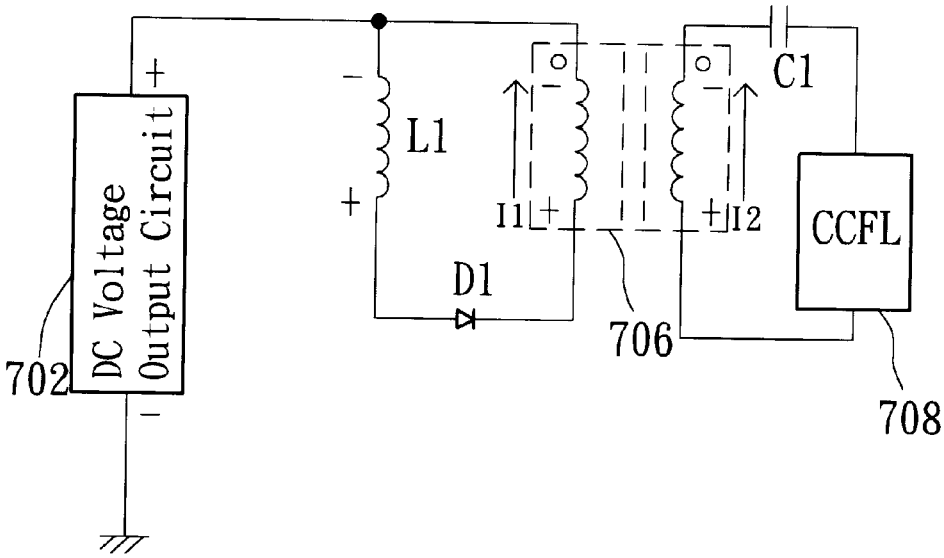
FIG. 9B is the equivalent circuit diagram of the power supply circuit 700 while the switch 704 is off.

FIG. 8 is a timing diagram of the gate-source voltage $V_{GS}$ of the switch 704, the inductor current $I_{L1}$ of the inductor L1, and the primary voltage $V_{T1}$ of the primary side of the transformer 712. The operating scheme is shown in FIGS. 9A to 9B. FIG. 9A is the equivalent circuit diagram of the power supply circuit diagram 700 when the switch 704 is on. At this time, the DC voltage output circuit 702 outputs the DC voltage to the inductor L1 and the primary side of the transformer 706 to ensure the same polarity of the primary voltage $V_{T1}$, and the voltage of the inductor L1. The inductor current $I_{L1}$ increases with time due to the characteristic of the inductor, and thus the preserved electromagnetic energy of the inductor L1 also increases with time. In other words, the electromagnetic energy is stored in the inductor L1 when the power supply circuit 700 supplies the primary voltage $V_{T1}$ when the switch 704 is on. FIG. 9B is the equivalent circuit diagram of the power supply circuit 700 while the switch 704 is off. At this time, the inductor L1 releases the preserved electromagnetic energy. The direction of the current of the inductor L1 remains the same as that in FIG. 9A, and the magnitude of the current of the inductor L1 decreases with time. The inductor current $I_{L1}$ flows from the inductor L1 to the primary side of the transformer 706 to convert the polarity of the primary voltage $V_{T1}$ to negative. By controlling the on/off status of the switch 704, the polarity of the primary voltage $V_{T1}$ alternates accordingly, as shown in FIGS. 9A and 9B. At the same time, the directions and the magnitudes of the primary current $I_{L1}$ and the secondary current $I_{L2}$ also change accordingly. With an adequate turn ratio of the primary side and the secondary side, the transformer 706 steps up the primary voltage and accordingly outputs the secondary voltage at the secondary side for driving the CCFL 708.

The power supply circuit 700 has less electrical components and each component is simpler. Thus the manufacture of the power supply circuit 700 is simpler, and accordingly the cost and manufacturing time is reduced. In addition, since only one switch 704 is required, the control mechanism becomes simpler and the complexity of the switch control circuit 710 is reduced.

As described above, the CCFL is started up according to the high AC voltage. The start-up voltage varies with the diameter, length, and used time of the CCFL. The start-up voltage of the CCFL is normally 1200 to 1800 V. A larger start-up voltage is required if the used time of the CCFL increases. Besides, about only one third of the start-up voltage is required to maintain the lighting of the CCFL after the start-up of the CCFL.

Figure 7B:
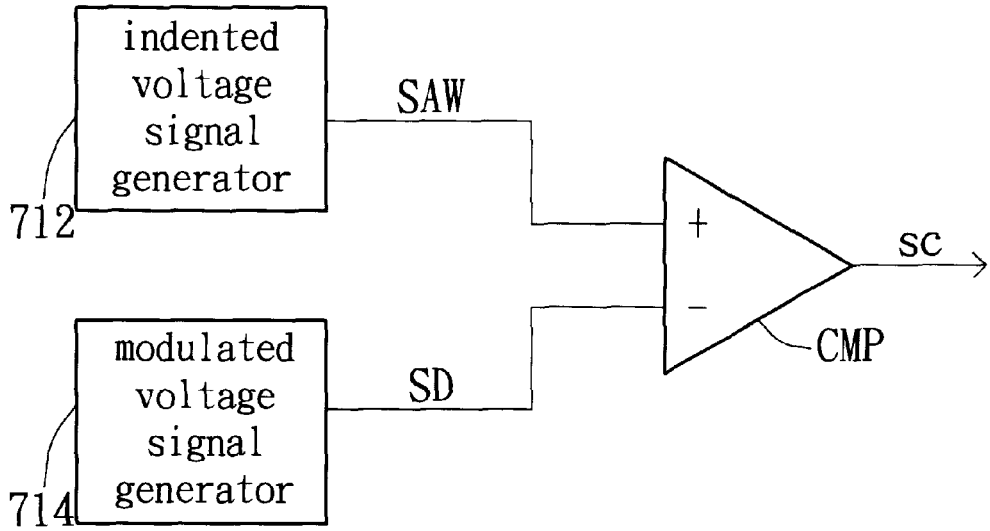
FIG. 7B is the diagram of a switch control circuit 710.
Figure 10A:
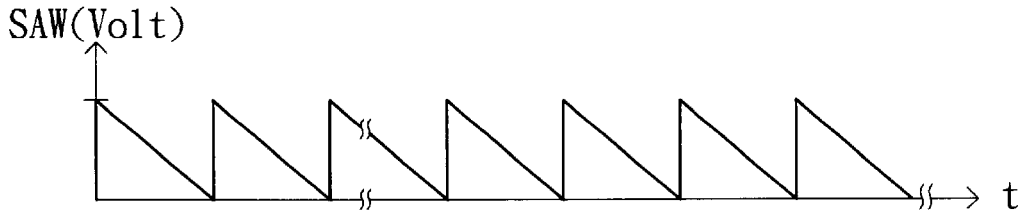
FIG. 10A is the timing diagram of the indented voltage signal SAW.
Figure 10B:
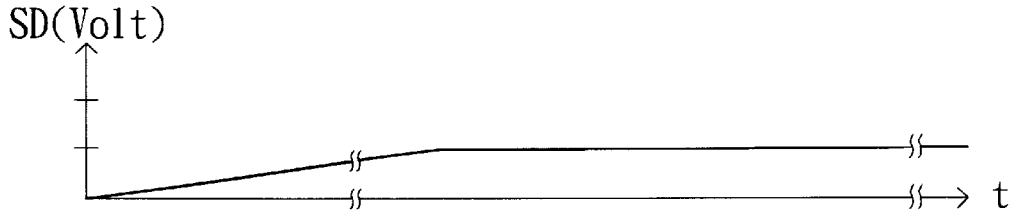
FIG. 10B is the timing diagram of the modulated voltage signal SD.
Figure 10C:
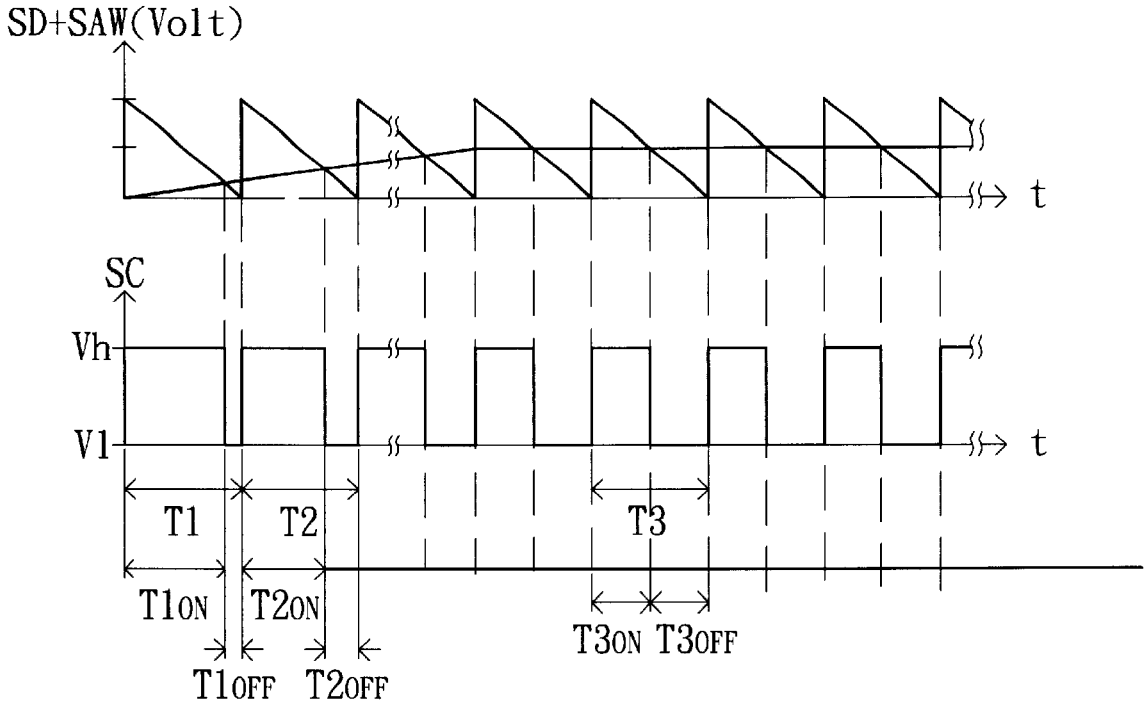
FIG. 10C is the timing diagram of the control signal SC.

FIG. 7B is a circuit diagram of the switch control circuit 710. The switch control circuit 710 uses pulse width modulation (PWM) method to output the control signal SC to control the on/off status of the switch. By alternating the on/off status of the switch 704, a high AC voltage is generated to drive the CCFL. FIGS. 10A to 10C are timing diagrams when the switch control circuit 710 utilizes the PWM method to generate the control signal SC. First, an indented voltage signal SAW, as shown in FIG. 10A, is generated by the indented voltage signal generator 712 while the CCFL is starting up. A modulated voltage signal SD, which increases with time, is also generated by the modulated voltage signal generator 714. When the magnitude of the modulated voltage signal SD reaches a half of the maximum magnitude of the indented voltage signal SAW, the magnitude of the modulated voltage signal SD then remains constant, as shown in FIG. 10B. The comparator CMP compares the magnitude of the indented voltage signal SAW and the modulated voltage signal SD so as to output the control signal SC. When the modulated voltage signal SD is larger than the indented voltage signal SAW, the control signal SC is high (Vh); when the modulated voltage signal SD is smaller than the indented voltage signal SAW, the control signal SC is low (V1), as shown in FIG. 10C. Therefore, the control signal SC is a square wave, and the duty ratio of the square wave, that is, the time ratio of the high level and the low level of the square wave, corresponds to the difference in magnitude between the modulated voltage signal SD and the indented voltage signal SAW. The control mechanism, which controls the magnitude of the modulated voltage signal SD to obtain a desired duty ratio of the outputted control signal SC, is called PWM method.

Referring to FIGS. 7A and 10C, the modulated voltage signal SD is quite small and accordingly the duty ratio of the control signal SC is high when the CCFL is starting up. Take period T1 for example. The duration of the high control signal SC, $T1_{ON}$, is much longer than the duration of the low control signal SC, $T1_{OFF}$. Thus, the outputted voltage of the transformer 706 is high enough to start up the CCFL because the switch 704 remains on for a longer time, and the polarity of the voltage of the transformer 706 remains the same for a longer time. The invention provides the high output voltage to start up the CCFL by adequately controlling the duty ratio of the control signal SC and the turn ratio of the transformer. The duty ratio of the control signal SC decreases with time because the modulated voltage signal SD increases with time. Thus, the outputted AC voltage by the power supply circuit 700 decreases with time. Take period T2, next to the period T1, for example. The duration of the high control signal SC of period T1, $T1_{ON}$, is longer than the duration of the high control signal SC of period T2, $T2_{ON}$. The duration of the low control signal SC of period T1, $T1_{OFF}$, is shorter than the duration of the low control signal SC of period T2, $T2_{OFF}$. Therefore, the duty ratio of the control signal SC of period T2 is smaller than that of period T1.

This embodiment provides a switch control circuit 710 for controlling the rate of increasing the magnitude of the modulated voltage signal SD, in order to enable the power supply circuit 700 to output the high AC voltage to start up the CCFL at the beginning periods. Because the high AC voltage is outputted at several periods, the possibility of failing to start up the CCFL is reduced. The duty ratio of the control signal SC decreases after the CCFL started up. The modulated voltage signal SD remains constant after the magnitude thereof reaching a half of the maximum magnitude of the indented voltage signal SAW. At that time, the duty ratio is 50%; that is, the switch is alternately on and off for the equal period of time. Thus, the power supply circuit 700 continuously outputs the low AC voltage to the CCFL 708, which can avoid the damage to the CCFL caused by long-time operating in high AC voltage. Therefore, the lifetime and the efficiency of the CCFL are improved.

The invention has fewer electrical components compared to the prior arts, and accordingly the manufacture is easier and more economic. In addition, only one switch is required, which simplifies the control mechanism.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A power supply circuit for a cold-cathode fluorescent lamp (CCFL), the power supply circuit being coupled to a DC (Direct Current) voltage output circuit and the CCFL, the DC voltage output circuit outputting a low DC voltage, and the power supply circuit converting the low DC voltage to a high AC voltage for driving the CCFL, the power supply circuit comprising:

a switch comprising a control node, a ground node, and a signal node;

a switch control circuit coupled to the control node, for outputting a control signal to control the on/off status of the switch;

a transformer having a primary side and a secondary side, the primary side having a first node and a second node, the secondary side having a third node and a fourth node, the first node coupled to the DC voltage output circuit, the second node coupled to the signal node of the switch;

an energy-preserving unit for preserving electrical energy, having a fifth node and a sixth node, the fifth node being coupled to the first node of the primary side of the transformer and the DC voltage output circuit; and a decoupling capacitor coupled to the third node of the secondary side of the transformer for outputting the high AC voltage.

2. The power supply circuit according to claim 1, wherein the switch further comprises a first diode, the first diode has a positive node and a negative node, the positive node is coupled to the signal node of the switch, and the negative node is coupled to the ground node of the switch.

3. The circuit according to claim 2, wherein the first diode is the body diode of the switch.

4. The circuit according to claim 2, wherein, the first diode is an external diode.

5. The circuit according to claim 1, wherein, the switch control circuit outputs the control signal using width modulation (PWM).

6. The circuit according to claim 5, wherein, the PWM comprises:

increasing a modulated voltage signal;

determining if the magnitude of the modulated voltage signal reaches a half of maximum magnitude of an indented voltage signal, if yes, fixing the magnitude of the modulated voltage signal; and outputting the control signal according to the modulated voltage signal and the indented voltage signal.

7. The circuit according to claim 6, wherein the control signal is a square wave, the duty ratio of the square wave is determined according to the magnitude of the modulated voltage signal and that of the indented wave voltage signal.

8. The circuit according to claim 1, the decoupling capacitor and the fourth node of the secondary side of the transformer are coupled to the CCFL.

9. The circuit according to claim 1, wherein the switch is a MOSFET (Metal Oxide Semiconductor Field Effect Transistor).

10. The circuit according to claim 9, wherein the MOSFET has a gate, a drain, and a source; the gate is coupled to the switch control circuit; the drain is coupled to the second node of the primary side of the transformer and the first diode; and the source is grounded.

11. The circuit according to claim 1, wherein the energy-preserving unit is an inductor.

* * * * *